US011746535B2

(12) United States Patent
Horton et al.

(10) Patent No.: US 11,746,535 B2
(45) Date of Patent: Sep. 5, 2023

(54) IMPERVIOUS WALL PANEL

(71) Applicant: BUSHBOARD LTD, Wellingborough (GB)

(72) Inventors: Neil Horton, Peterborough (GB); Shashi Patel, Wellingborough (GB); Steve Lubowinski, Salado, TX (US); Arvind S. Karthikeyan, Temple, TX (US); Rajesh Ramamurthy, Temple, TX (US)

(73) Assignee: BUSHBOARD LTD, Wellingborough (GB)

( * ) Notice: Subject to any disclaimer, the term of this patent is extended or adjusted under 35 U.S.C. 154(b) by 0 days.

(21) Appl. No.: 16/722,247

(22) Filed: Dec. 20, 2019

(65) Prior Publication Data

US 2020/0123784 A1 Apr. 23, 2020

Related U.S. Application Data

(63) Continuation of application No. 16/356,073, filed on Mar. 18, 2019, now Pat. No. 10,563,410, which is a (Continued)

(30) Foreign Application Priority Data

Mar. 11, 2015 (GB) ..... 1504115

(51) Int. Cl.
*E04F 13/08* (2006.01)

(52) U.S. Cl.
CPC ..... *E04F 13/0876* (2013.01); *E04F 13/0871* (2013.01); *E04F 13/0894* (2013.01); *E04F 2201/0107* (2013.01); *E04F 2201/023* (2013.01)

(58) Field of Classification Search
CPC ... E04F 13/16; E04F 13/0866; E04F 13/0885; E04F 15/107; E04F 13/0876;
(Continued)

(56) References Cited

U.S. PATENT DOCUMENTS 2,151,447 A * 3/1939 Stanley ..... E04F 13/18 52/309.13
2,202,568 A * 5/1940 Worden ..... E04F 13/0801 52/387

(Continued)

FOREIGN PATENT DOCUMENTS

DE 10001227 C1 5/2001
DE 102008051441 A1 3/2010

(Continued)

OTHER PUBLICATIONS

Prosecution History for U.S. Patent Application Publication 2014/0037917.

*Primary Examiner* — Paola Agudelo
(74) *Attorney, Agent, or Firm* — Welsh Flaxman & Gitler LLC

(57) ABSTRACT

A water impervious wall panel system includes an intermediate first wall panel composed of a waterproof core and a decorative surfacing attached to the core, wherein the intermediate first wall panel is provided with tongue-and-groove edges. The water impervious wall panel system also includes an end second wall panel composed of a waterproof core and a decorative surfacing attached to the core, wherein the end second wall panel is provided with a tongue-and-groove edge and a rolled edge. One of the tongue-and-groove edges of the intermediate first wall panel and the tongue-and-groove edge of the end second wall panel form an interlocking system having a contact area adjacent to a front face of the intermediate first wall panel and the end second wall panel and a gap adjacent a rear face of the intermediate first (Continued)

wall panel and the end second wall panel, the contact area surface extending across less than the thickness of the intermediate first wall panel and the end second wall panel so as to provide a tight joint at the front face and eliminate visible gaps.

5 Claims, 7 Drawing Sheets

Related U.S. Application Data continuation-in-part of application No. 15/557,287, filed as application No. PCT/GB2016/050459 on Feb. 23, 2016, now Pat. No. 10,273,697.

(58) Field of Classification Search
CPC ..... E04F 13/0871; E04F 13/0894; E04F 2201/0107; E04F 2201/023
See application file for complete search history.

(56) References Cited

U.S. PATENT DOCUMENTS 2,527,903 A * 10/1950 Axlrod ..... A47C 27/04 24/457
2,693,102 A 11/1954 Luster et al.
2,779,983 A * 2/1957 Sundelin ..... E04F 19/061 52/282.4
3,310,919 A * 3/1967 Bue ..... E04F 15/02 52/591.1
3,579,396 A 5/1971 Washbum et al.
3,624,236 A * 11/1971 Frappier ..... B31F 1/2827 428/126
3,646,180 A * 2/1972 Winnick ..... B29C 44/12 264/45.3
3,817,012 A * 6/1974 Wack ..... E04F 13/0801 52/315
4,372,901 A * 2/1983 Kim ..... B29C 44/18 264/261
6,874,292 B2 4/2005 Moriau et al.
D595,431 S * 6/2009 Day ..... D25/140
7,559,177 B2 * 7/2009 Stanchfield ..... E04F 15/02011 52/459
8,028,486 B2 10/2011 Pervan et al.
8,061,104 B2 11/2011 Pervan
9,855,718 B2 1/2018 Riebel et al.
2002/0020127 A1 * 2/2002 Thiers ..... E04C 2/10 52/578
2004/0035077 A1 2/2004 Martensson et al.
2004/0211144 A1 10/2004 Stanchfield
2005/0208255 A1 9/2005 Pervan
2006/0032175 A1 2/2006 Chen et al.
2007/0116931 A1 5/2007 Lu
2007/0283654 A1 * 12/2007 Stanchfield ..... B23D 45/003 52/465
2009/0173030 A1 * 7/2009 Gulbrandsen ..... E04B 9/0414 52/506.09
2010/0055420 A1 * 3/2010 Vermeulen ..... B32B 5/18 428/207
2011/0239574 A1 * 10/2011 Morris ..... E04D 13/1631 52/506.06
2014/0037917 A1 2/2014 Branch et al.
2014/0109507 A1 4/2014 Dossche et al.
2015/0343739 A1 * 12/2015 Pervan ..... B32B 5/30 52/582.1
2016/0083965 A1 3/2016 Baert et al.
2016/0288447 A1 10/2016 Cordeiro
2017/0165936 A1 6/2017 Schulte

FOREIGN PATENT DOCUMENTS

DE 102012102379 A1 3/2013
EP 1020504 A1 7/2000
WO 2012112110 A1 8/2012

* cited by examiner

IMPERVIOUS WALL PANEL

BACKGROUND OF THE INVENTION

1. Field of the Invention

The present invention relates to a wall panel, and in particular to a water-impervious wall panel suitable for bathrooms, wetrooms and the like.

2. Description of the Related Art

Current wall panels for bathrooms, etc. are almost exclusively manufactured using wood based substrates with unfinished edges. These require extrusions, end-caps and silicone to provide protection from water ingress, panel delamination and damage to the building infrastructure. The silicone seal will break down over time and need replacing. The integrity of the wall covering is dependent on how well the panels are installed. The extensive use of extrusions detracts from the aesthetic of the installation and reduces the maintenance benefits of avoiding tile grout lines.

SUMMARY OF THE INVENTION

It is, therefore, an object of the present invention to provide a water impervious wall panel system including an intermediate first wall panel composed of a waterproof core and a decorative surfacing attached to the core, wherein the intermediate first wall panel is provided with tongue-and-groove edges. The water impervious wall panel system also includes an end second wall panel composed of a waterproof core and a decorative surfacing attached to the core, wherein the end second wall panel is provided with a tongue-and-groove edge and a rolled edge. One of the tongue-and-groove edges of the intermediate first wall panel and the tongue-and-groove edge of the end second wall panel form an interlocking system having a contact area adjacent to a front face of the intermediate first wall panel and the end second wall panel and a gap adjacent a rear face of the intermediate first wall panel and the end second wall panel, the contact area surface extending across less than the thickness of the intermediate first wall panel and the end second wall panel so as to provide a tight joint at the front face and eliminate visible gaps.

In accordance with the invention, there is provided a water impervious wall panel comprising a core of a wood plastic composite (WPC), a stone plastic composite (SPC), a plastic composite, or a filled foamed plastic substrate. A laminate is adhesively attached to the core or an image is applied directly to the core using digital printing techniques or other image creation techniques as may become available.

In accordance with one embodiment, the core is a wood plastic composite foamed board. The wood plastic composite preferably comprises PVC and wood fibre. The wood plastic composite may include recycled materials.

In accordance with another embodiment, the core is a plastic composite preferably comprised of PVC (polyvinyl chloride) and various binders or a filled foamed plastic substrate comprised of a solid polymer matrix having voids of air or other gas dispersed therein.

The decorative image of the panel is provided by a laminate, preferably a high pressure laminate, high performance veneer, digitally printed surfacing material, etc. In accordance with an alternate embodiment, the laminate may be removed, and the decorative surface could be digitally printed directly upon the core.

The adhesive is preferably a polyurethane adhesive. Although the laminate may be attached only to one major surface of the core, preferably the laminate is attached to both major surfaces of the core to improve the water-impervious properties of the panel. By attaching laminate to both sides of the core, a symmetric and balanced panel results.

In a preferred embodiment, the wall panel is provided with a rolled edge along at least one side. This provides a more aesthetically pleasing edge. A plurality of panels may be placed next to one another to cover a larger area than just one panel. To facilitate a secure join between panels, the wall panel may be provided with a tongued or grooved edge along at least one side. Preferably, the wall panel is provided with a tongue-and-groove interlocking system.

The tongue-and-groove interlocking system may be configured to provide a contact area across less than the width of the panel. The contact area is preferably provided adjacent to the front face of the panel. This achieves a tight join at the front face and eliminates a visible gap. It also increases tolerance for machining errors or variation. The system as a whole is designed to provide tolerance for walls which are not precisely planar but may be bowed or uneven to a certain extent. The tongue may be provided with a beveled edge, which allows the panel to be inserted at an angle.

The wall panel, in accordance at least with one embodiment of the invention, is made from a core of wood plastic composite (WPC) material covered with a laminate which is bonded to the core by means of adhesive. The resulting panel is water-impervious and the system does not require the use of joining extrusions between the panels when a plurality of panels are placed next to each other. This simplifies installation and reduces cost. The combination of materials in the panels themselves results in a panel which is not only water-impervious but also has excellent insulating characteristics which will help retain room temperature and reduce wall panel surface condensation.

Other objects and advantages of the present invention will become apparent from the following detailed description when viewed in conjunction with the accompanying drawings, which set forth certain embodiments of the invention.

BRIEF DESCRIPTION OF THE DRAWINGS

Embodiments of the invention will now be described by way of example only and with reference to the accompanying drawings, in which.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 1:
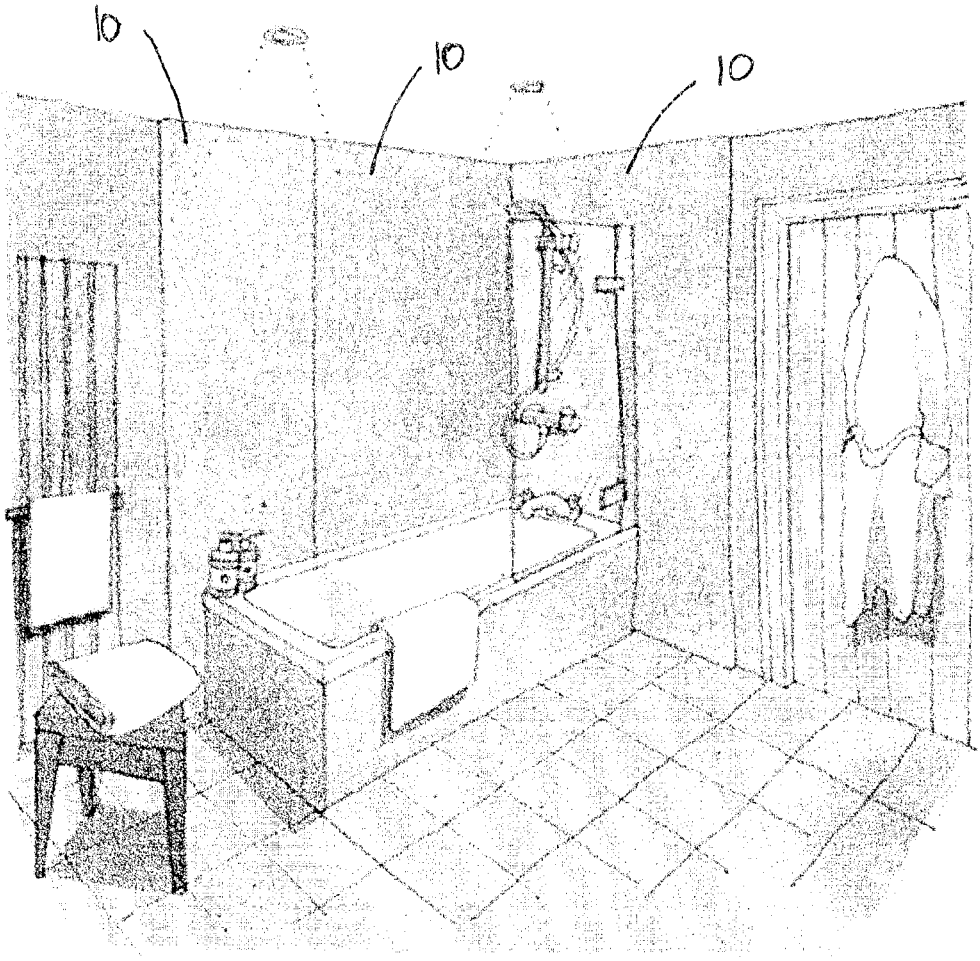
FIG. 1 shows a general perspective view of a typical bathroom employing wall panels in accordance with the invention.

With reference to FIG. 1, a typical bathroom is fitted with wall panels 10 in the areas likely to come into contact with water.

Figure 2:
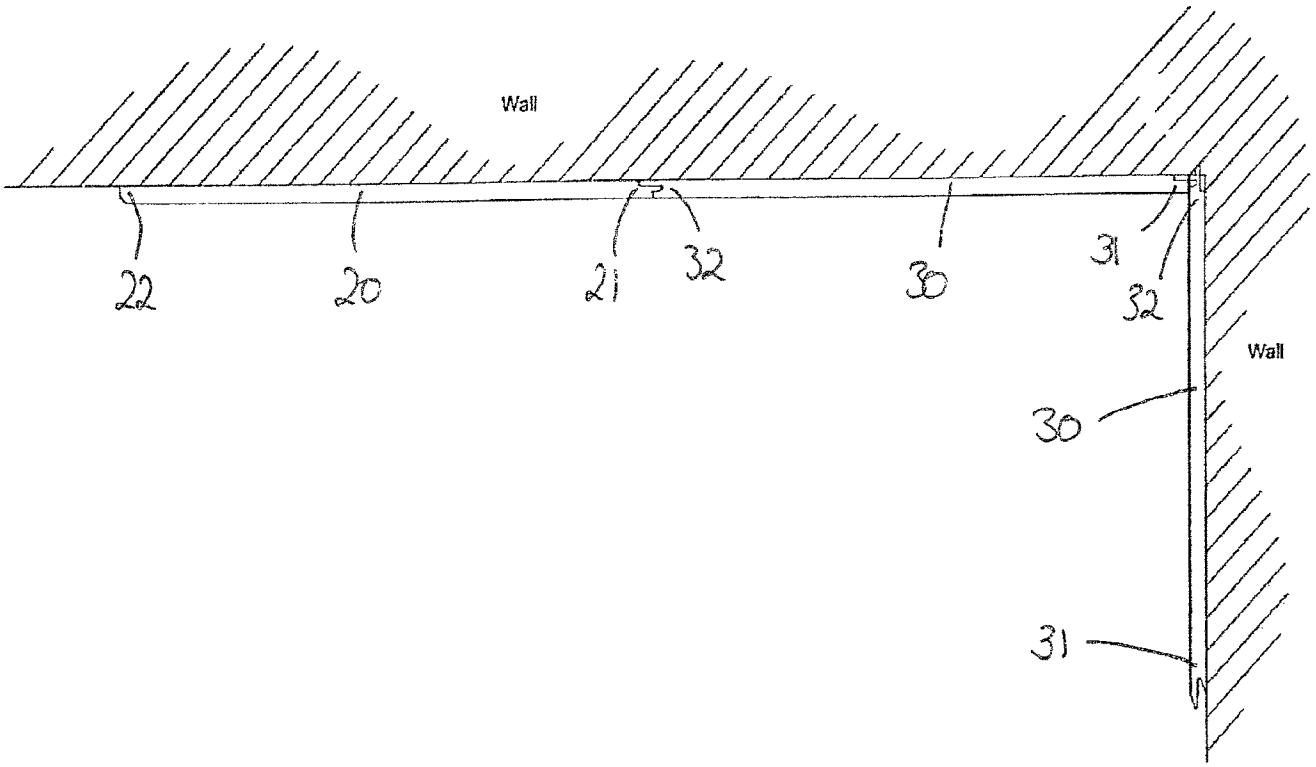
FIG. 2 shows a plan cross-sectional view of an installation employing wall panels in accordance with the invention.

FIG. 2 shows a plan cross-sectional view of an installation employing wall panels in accordance with the invention, which could be employed in the bathroom of FIG. 1. This installation employs an end panel 20 and two intermediate panels 30. The intermediate panels 30 are provided with tongue-and-groove edges 31 and 32 whereas end panel 20 has one tongue or groove edge 21 and a rolled edge 22 to make the exposed end of the panel aesthetically pleasing. In the corner where the two intermediate panels 30 meet, the tongue-and-groove edges 31 and 32 are scribed to fit, so that the outer, visible surfaces of each panel mate together. While tongue-and-groove edges are disclosed in the corners in accordance with a disclosed embodiment, it is appreciated the corner construction may be varied to suit specific needs and installation requirements. For example, a butt seam sealed with a high elongation modified silane adhesive might be employed in corners without departing from the spirit of the present invention.

Figure 3:
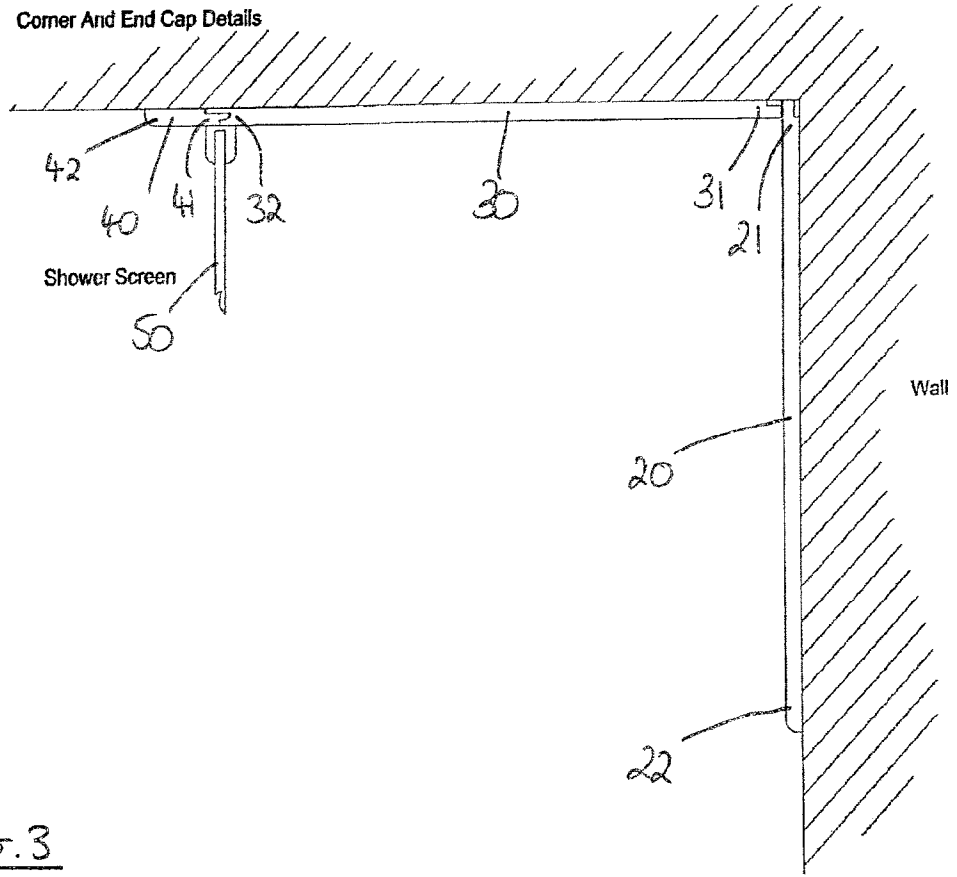
FIG. 3 shows a plan cross-sectional view of another installation employing wall panels in accordance with the invention.

FIG. 3 shows a plan cross-sectional view of another installation employing wall panels in accordance with the invention, such as a shower installation. This installation employs an end panel 20, an intermediate panel 30 and an end strip 40. As with FIG. 2, end panel 20 has one tongue or groove edge 21 and a rolled edge 22, and intermediate panel 30 is provided with tongue-and-groove edges 31 and 32. End strip 40 is similar to end panel 20, with one tongue or groove edge 41 and a rolled edge 42, but is narrower in width. A section of shower screen 50 is also shown. In the corner where the end panel 20 and the intermediate panel 30 meet, the tongue-and-groove edges 21 and 31 are scribed to fit, so that the outer, visible surfaces of each panel mate together. As discussed above with reference to FIG. 2, the tongue-and-groove construction disclosed in the corner may be varied to suit specific needs and installation requirements. For example, a butt seam sealed with a high elongation modified silane adhesive might be employed in corners without departing from the spirit of the present invention.

Figure 4:
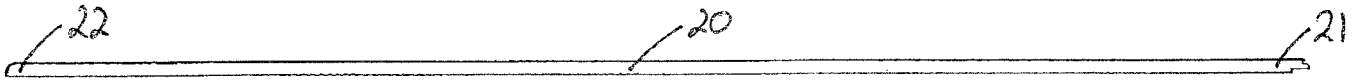
FIG. 4 shows a cross-sectional view of a wall panel in accordance with a preferred embodiment.

FIG. 4 shows a cross-sectional view of an end panel 20 having one tongue or groove edge 21 and a rolled edge 22.

Figure 5:
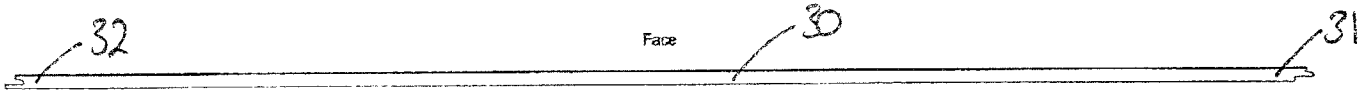
FIG. 5 shows a cross-sectional view of a wall panel in accordance with another preferred embodiment.

FIG. 5 shows a cross-sectional view of an intermediate wall panel 30 with tongue-and-groove edges 31 and 32.

Figure 6:
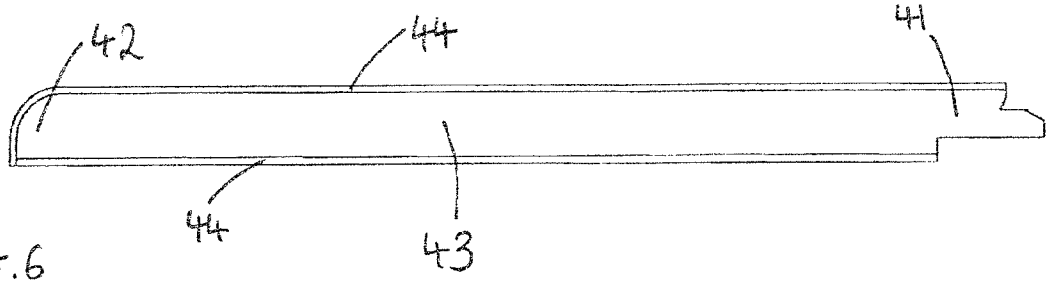
FIG. 6 shows a cross-sectional view of a wall panel in accordance with a further preferred embodiment.

FIG. 6 shows a cross-sectional view of an end strip 40 with one tongue or groove edge 41 and a rolled edge 42. In this figure, the core 43 and laminates 44 can be seen. All panels in accordance with the invention are formed with a core and laminate, as described further below. The panels shown in FIG. 6, is in accordance with one embodiment as discussed below wherein the panels are constructed with front and rear laminates 44.

Figure 7:
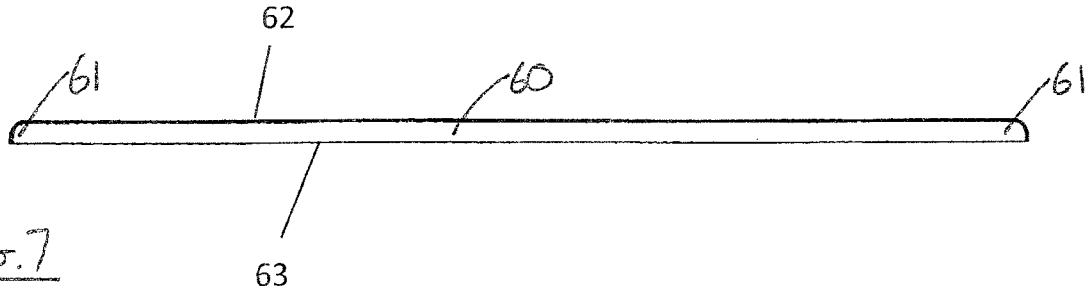
FIG. 7 shows a cross-sectional view of a wall panel in accordance with a still further preferred embodiment.

FIG. 7 shows a cross-sectional view of a further embodiment of a wall panel 60 in accordance with the invention, which is provided with rolled edges 61 at each end.

Figure 8:
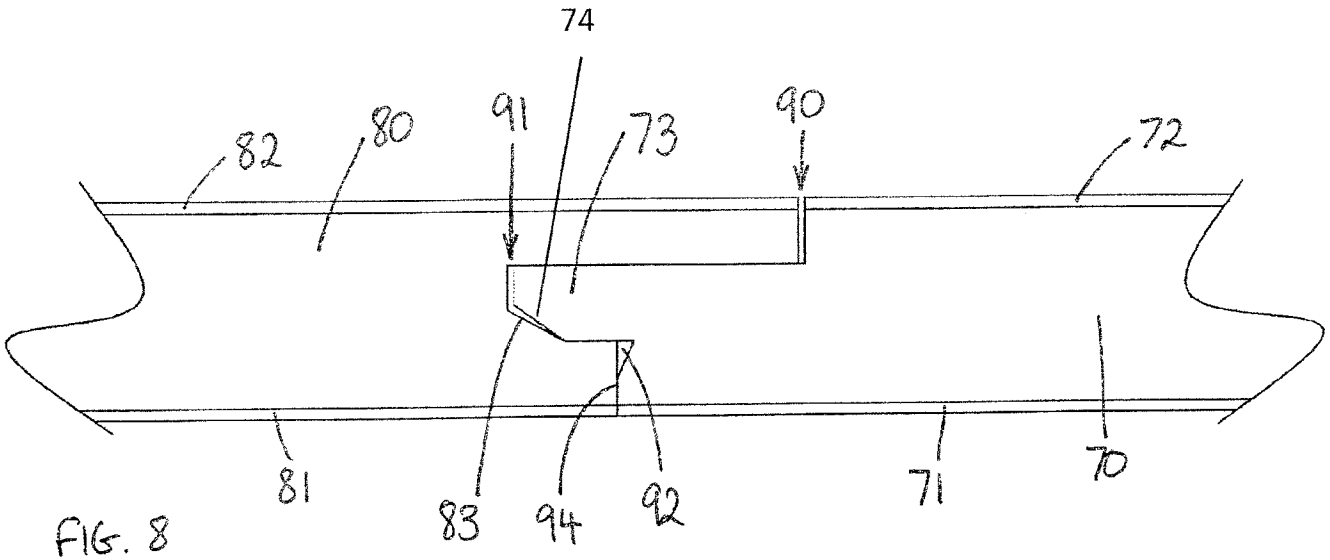
FIG. 8 shows an enlarged cross-sectional view of a tongue-and-groove engagement between two wall panels in accordance with the invention.
Figure 9:
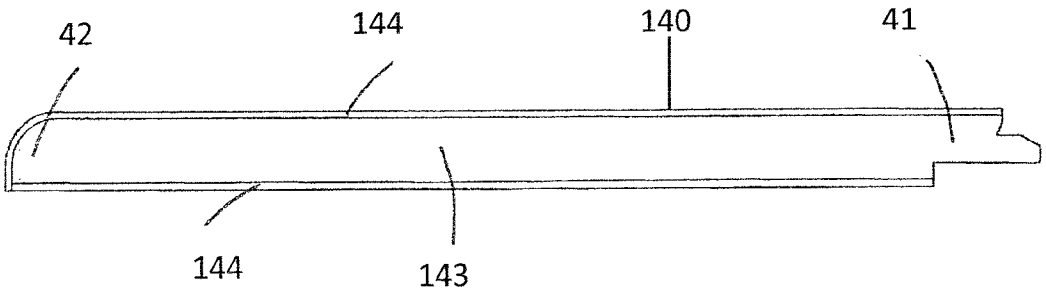
FIG. 9 shows a cross-sectional view of a wall panel in accordance with a further preferred embodiment.
Figure 10:
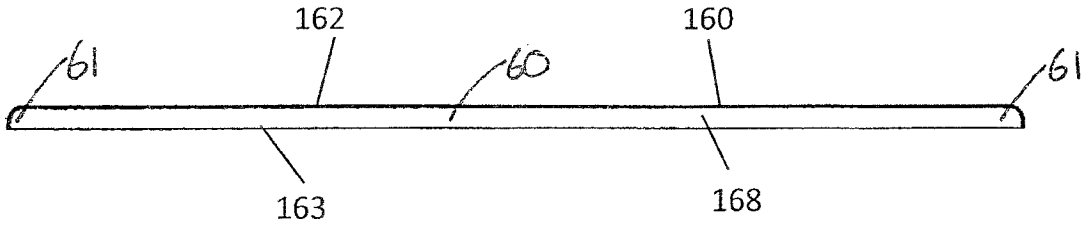
FIG. 10 shows a cross-sectional view of a wall panel in accordance with a still further preferred embodiment.
Figure 11:
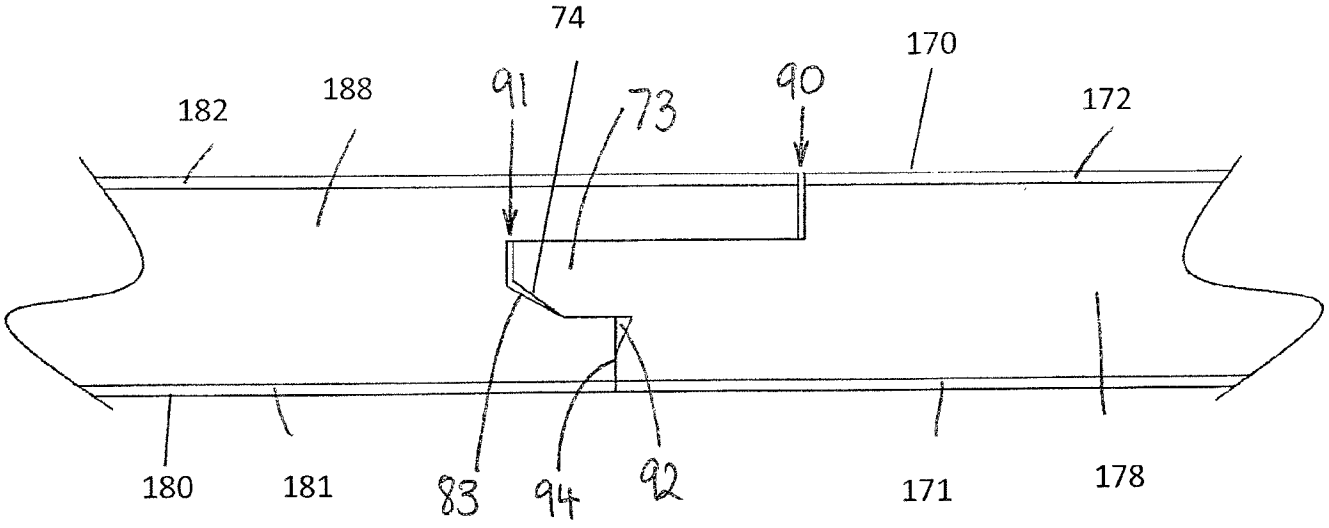
FIG. 11 shows an enlarged cross-sectional view of a tongue-and-groove engagement between two wall panels in accordance with the invention.

FIG. 8 shows an enlarged cross-sectional view of a tongue-and-groove engagement between two wall panels 70 and 80 in accordance with the invention. The panels shown in FIG. 8 are in accordance with one embodiment as discussed below wherein the panels 70, 80 are constructed with front laminates 71 and 81 and rear laminates 72 and 82.

The tongue-and-groove system is designed such that contact between the two panels in the orthogonal direction (i.e. across the thickness of the panels) is minimized and is concentrated at the front face of the panels. This achieves a tight join at the front face and eliminates a visible gap. It also increases tolerance for machining errors or variation.

Panel 70 is provided with a tongue 73 and panel 80 is provided with a groove 83. When the panels are fully interlocked, gaps 90, 91 and 92 are designed to exist and contact area 94 is kept relatively small and located at the front face of the panels. These features also provide a certain amount of tolerance in the event that the wall onto which the panels are being installed is not perfectly planar but is bowed or uneven to a certain extent. Gaps 90, 91 and 92 also provide an overspill reservoir for adhesive. Gap 92 is a notch cut into the side face of the panel. Tongue 73 is provided with a bevel 74 which allows the panel to be inserted at an angle. This feature is useful when installing up to a fixed end.

Considering the need for profiling along the edges of the core, the core must be thick enough to be machined with standard tools, or otherwise be manufactured, to include the rolled edge and tongue or groove profile described above. With this in mind, it is contemplated the core must be at least 6 mm thick, preferably at least 10 mm.

In accordance with one embodiment, the wall panels described above are made from a core of wood plastic composite (WPC) material covered with a laminate which is bonded to the core by means of polyurethane (PUR) adhesive. In accordance with an alternate embodiment, and as discussed below in greater detail, the wall panels described above are made from a core of plastic composite material or a filled foamed plastic substrate covered with a laminate which is bonded to the core by means of polyurethane (PUR) adhesive.

Regardless of the specific construction of the panel, it is water-impervious, and the system does not require the use of joining extrusions between the panels (that is, additional trim pieces positioned over the seam between adjacent panels). This simplifies installation and reduces cost. The combination of materials in the panels themselves results in a panel which is not only water-impervious but also has excellent insulating characteristics which will help retain room temperature and reduce wall panel surface condensation. The primary components employed in the construction of the panels are discussed separately below. It should be noted that while various embodiments regarding decorative surfacing and core materials are discussed below, reference numerals used above regarding structural elements of the panels are the same and these structures do not change as the decorative surfacing and core materials change.

Decorative Surface

It is appreciated the embodiments of the decorative surface discussed below could be made with any of the core materials discussed later in the application. That is, a laminate based panel or a digitally printed panel could be made with, a WPC substrate, a plastic composite material, a filled foamed plastic substrate, or another material fulfilling the characteristics of a core in accordance with the present invention.

Face and Backing Laminates

In accordance with one embodiment as shown with reference to FIGS. 6, 7, and 8, both face and backing laminates 44, 62, 63, 71, 72, 81, 82 are high pressure laminates, high performance veneer, digitally printed surfacing material, etc. Face laminates 44, 62, 72, 82 can be plain or decorative, whereas backing laminates 44, 63, 71, 81 are likely to be plain. Preferred laminates are manufactured using layers of Kraft paper impregnated with phenolic resins, decorative paper impregnated with melamine resin and printed decors which are protected using durable overlay covering. Resin impregnated layers are fused together under high pressure and temperature to activate the melanine and phenolic resins resulting in a robust fused waterproof surface.

Digitally Printed Decorative Surfacing

In accordance with an alternate embodiment, and as briefly mentioned above, the facing laminate 44, 62, 72, 82 may be replaced with a digitally printed decorative surfacing 144, 162, 172, 182 applied directly upon the core 143, 168, 178, 188. In accordance with such an embodiment, the panels 140, 160, 170, 180 are constructed without a facing laminate structure 44, 62, 72, 82. While the facing laminate structure is replaced with the digitally printed decorative surfacing 144, 162, 172, 182, the back of the core 143, 168, 178, 188 is still provided with a matching symmetric laminate 44, 63, 71, 81.

The core 143, 168, 178, 188, whether a WPC substrate, a plastic composite material, a filled foamed plastic substrate, or another material fulfilling the characteristics of a core in accordance with the present invention, is subjected to digital printing and surface coating. The digital printing and surface coating may be as disclosed in U.S. Patent Application Publication No. 2014/0037917, entitled "PRINTED LAMINATE WITH DIGITAL PRINTING AND METHOD FOR MANUFACTURE," which is incorporated by reference.

Where digital printing and surface coating are employed in conjunction with the core 143, 168, 178, 188, the core 143, 168, 178, 188 is treated and digitally printed in a manner disclosed below in detail. The core 143, 168, 178, 188 includes a top surface 143*t*, 168*t*, 178*t*, 188*t* and bottom surface 143*b*, 168*b*, 178*b*, 188*b*, as well exposed side edges 143*e*, 168*e*, 178*c*, 188*e* extending between the top surface 143*t*, 168*t*, 178*t*, 188*t* and bottom surface 143*b*, 168*b*, 178*b*, 188*b*. In accordance with this embodiment, the bottom surface 143*b*, 168*b*, 178*b*, 188*b* and the side edges 143*e*, 168*e*, 178*e*, 188*e* are left uncovered and do not pose a water issue because the material from which the core 143, 168, 178, 188 is made is itself water impervious. The core 143, 168, 178, 188 is first prepared to optimize the reception of UV inks for example, with the application of an adhesion promoting layer and/or a tie coating encouraging bonding of the ink with the core 143, 168, 178, 188. The core 143, 168, 178, 188 is then printed upon using digital printing techniques. A top coat layer is applied to the printed core, wherein the top coat layer includes a clear hot melt polyurethane layer followed by a clear UV cured acrylic coating layer.

Where digital printed decorative surfacing is employed as described above, the surface thereof may be enhanced with the provision of texture. For example, digital printing techniques like the one described in U.S. Pat. No. 9,855,718, entitled "MULTI-LAYER ADDITIVE TEXTURE LAMINATES AND METHODS," which is incorporated herein by reference, or other image creation techniques as may become available may be used to create the image layer of the panels.

Core

WPC

In accordance with one embodiment of the present invention, WPC is a relatively recent material which combines plastic with wood fibre. WPC can be injection molded to form shapes or extruded to make moldings and sheets. The core substrate of panels in at least one preferred embodiment will be WPC foamed board. The main ingredients of WPC boards are approximately 50% PVC and approximately 20% wood fibre (although it is appreciated the wood content could be increased or decreased substantially in order to accommodate different needs dictated by different applications). Fillers, stabilizers, lubricants and foaming agents make up the remaining 30%. Recycled PVC and wood fibre materials can be used to manufacture WPC boards.

In accordance with a preferred embodiment, the WPC boards exhibit the following composition: 58% by weight PVC, 10% by weight wood fibre in the form of wood powder, 20% by weight calcite (activated calcium carbonate), 1.2% by weight lubricant (polyethylene wax), 4.5% by weight foaming agent, 6.3% by weight other. This specific embodiment of the core composed of a WPC board also has a thickness of approximately 10.1 mm, which allows for profiling of the edges thereof to allow for coupling in manner discussed above.

WPC boards are water and weather proof, naturally fire retardant due to their high PVC content, rot proof and can be worked with standard wood working tools. They are therefore very suitable for use in a bathroom material.

Plastic Composite/Filled Foamed Plastic

In accordance with an alternate embodiment, it is appreciated the core may be constructed from a plastic composite material or a filled foamed plastic substrate. The plastic composite material is preferably comprised of PVC (polyvinyl chloride) and various binders. The filled foamed plastic substrate is comprised of a solid polymer matrix having voids of air or other gas dispersed therein.

The plastic composite material or filled foamed plastic substrate exhibits the following composition: 40% to 60% by weight PVC and 10% to 30% by weight calcite (activated calcium carbonate), with the remainder of the composition being composed of lubricant (for example, polyethylene wax), foaming agent (for example, azodicarbonamide, and other application specific components known to those skilled in the art. As with WPC, cores composed of plastic composite material or filled foamed plastic may be made in a variety of thickness so as to allow for the creation of a profile along the edges thereof for coupling in manner discussed above.

Other Core Options

Further, it is contemplated the core could be composed of a foamed polyurethane product. The foamed polyurethane product may be manufactured from recycled or non-recycled materials. For example, Puren GmbH manufactures a foamed polyurethane product under the name PURENIT. PURENIT is a highly compressed smart material based on PUR (polyurethane)/PIR (polyisocyanurate). It is contemplated the core could be composed of a foamed PVC. It is also contemplated the core could be composed of a stone plastic composite (SPC), which is commonly composed of PVC, no forming agent, and a stone filler (for example, calcium carbonate).

While polymer based core materials are disclosed above, it is appreciated other materials might exhibit water resistant characteristics appropriate for use in accordance with the present invention. For example, some water resistant MDF materials could be employed in accordance with the present invention. Further thick high pressure laminates could be employed in accordance with the present invention. In addition, it is contemplated the PVC described above for use in conjunction with WPC and plastic composite/filled foamed plastic could be replaced with thermoplastic olefins, polypropylene, or high density polyethylene.

Regardless of the material chosen for the core, the core must be water and weather proof, rot proof, impact resistant, and capable of being worked with standard wood working tools. For example, and as discussed above, the core must be thick enough to be machined with standard tools, or otherwise be manufactured, to include the rolled edge and tongue/groove profile described above. With this in mind, it is contemplated the core must be at least 6 mm thick, preferably at least 10 mm. In addition, and considering the impact resistance of the panel, it is contemplated a density sufficient to provide for impact resistance for use in accordance with the present invention.

Bonding Adhesive

Where the panel includes a laminate structure secured to either a WPC core, a plastic composite core, or filled foamed plastic core, both the core and laminate sheets of a panel in accordance with the present invention are waterproof. The preferred adhesive for use as the bonding adhesive is also waterproof. It is, however, appreciated different adhesives offer different functional characteristics. With this in mind, a polyurethane adhesive is used in securing laminate to the core, a polyamide adhesive is used when securing the laminate along the rolled edge, and a high elongation modified silane adhesive is used at the joints of adjacent panels (in particular, at the tongue-and-groove joints discussed above, as well as other joints (for example, butt joints) that might be employed in accordance with the present invention) and when securing the panels to a wall.

In accordance with another embodiment, post-formed water impervious panels may be used in conjunction with the present invention. In accordance with such an embodiment, the panels are shaped to conform to a variety of underlying surfaces without the need for seams that might otherwise be required when using traditional flat panels. As with the prior embodiments, these panels would include edge profiles allowing multiple panels to be assembled side by side.

The post-formed water impervious panel of this embodiment is preferably composed of a post-formable core of wood plastic composite, plastic composite, or filled foamed plastic and a post-formable decorative laminate adhesively attached to the core. As with the flat panel embodiments discussed above, the decorative laminate could be removed and replaced with a digital printing and surface coating as disclosed in U.S. Patent Application Publication No. 2014/0037917, entitled "PRINTED LAMINATE WITH DIGITAL PRINTING AND METHOD FOR MANUFACTURE," which is incorporated by reference.

Regardless of the exact construction of the panels in accordance with the present invention, the outer surface thereof may be treated to optimize the functional characteristics thereof. For example, the outer surface may be treated to impart antimicrobial characteristics, self-cleaning characteristics, anti-fingerprint characteristics, and/or water repellency characteristics.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A water impervious wall panel system, comprising:

a plurality of wall panels, each of the wall panels being comprised of a waterproof core and a decorative surfacing attached to the core;

at least one of the plurality of wall panels includes coupling profiles along opposed edges thereof, wherein polyurethane adhesive secures the decorative surfacing to the waterproof core;

at least one of the plurality of wall panels includes a first edge having a coupling profile shaped and dimensioned for engagement with the coupling profile of the at least one of the plurality of wall panels includes coupling profiles along opposed edges thereof and a second edge with a rolled edge, wherein a polyamide adhesive secures the decorative surfacing to the waterproof core along the rolled edge.

2. The water impervious wall panel system according to claim 1, wherein the core is a wood plastic composite foamed board.

3. The water impervious wall panel system according to claim 1, wherein the core is a plastic composite material.

4. The water impervious wall panel system according to claim 1, wherein the core is a filled foamed plastic substrate.

5. The water impervious wall panel system according to claim 1, wherein the core is foamed polyurethane.

* * * * *